US006134188A

United States Patent [19]

Ganter et al.

[11] Patent Number: 6,134,188

[45] Date of Patent: Oct. 17, 2000

[54] ANTENNA FOR A RADIO-CONTROLLED WRISTWATCH

[75] Inventors: Wolfgang Ganter, Eschbronn-Locherhof; Reiuer Furch, Schilrach; Thomas Lechner, Tennenbronn; Holger Rudolph, Eschbronn-Locherhof; Johannes Neudecker, Schramberg, all of Germany

[73] Assignee: Junghans Uhren GmbH, Schramberg, Germany

[21] Appl. No.: 09/131,668

[22] Filed: Aug. 10, 1998

[30] Foreign Application Priority Data

Aug. 8, 1997 [DE] Germany ..... 297 14 185

[51] Int. Cl.[7] ..... G04C 11/02; G04B 37/00; A44C 5/00; H01Q 1/12

[52] U.S. Cl. ..... 368/47; 368/88; 368/278; 368/281; 343/718

[58] Field of Search ..... 368/10, 47, 85, 368/88, 276, 278, 281; 373/718

[56] References Cited

U.S. PATENT DOCUMENTS

| | | | |
|---|---|---|---|
| 4,645,357 | 2/1987 | Allgaier et al. . | |
| 4,650,344 | 3/1987 | Allgaier et al. . | |
| 4,947,179 | 8/1990 | Ganter et al. . | |
| 5,430,693 | 7/1995 | Ganter et al. . | |
| 5,625,366 | 4/1997 | D'Hont | 343/718 |
| 5,742,564 | 4/1998 | Kuschel et al. | 368/69 |

FOREIGN PATENT DOCUMENTS

| | | |
|---|---|---|
| 9 005932 | 3/1993 | Germany . |
| 93/18224 | 3/1994 | Germany . |
| 44 07 116 | 9/1995 | Germany . |
| 8-307141 | 11/1996 | Japan . |
| 686696 | 6/1996 | Switzerland . |

*Primary Examiner*—Vit Miska

*Attorney, Agent, or Firm*—Burns, Doane, Swecker & Mathis, LLP

[57] ABSTRACT

A radio-controlled wristwatch includes a casing, a printed circuit board disposed in the casing, and an antenna disposed in the casing. The antenna includes a core and a coil carried by the core. The core comprises a stack of soft-iron strips stacked in a direction parallel to a plane of the circuit board. The stack is arranged in a curved shape extending along and adjacent to an outer peripheral edge of the circuit board. The core is bonded to a surface of the circuit board and supports the coil within a pocket formed in the circuit board.

11 Claims, 1 Drawing Sheet

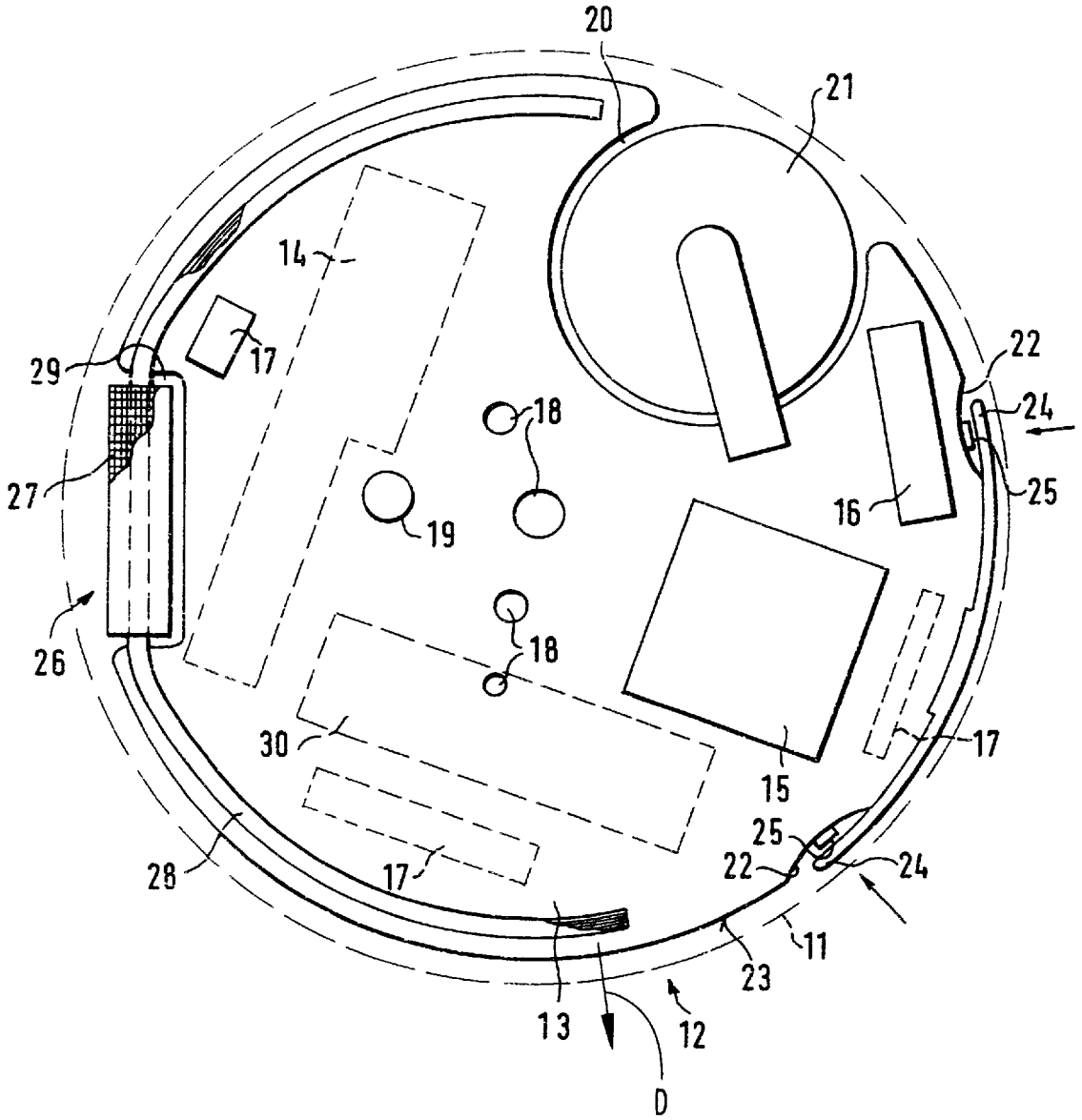
20
21
14
17
29
22
24
18
27
25
16
19
26
18
30
17
15
25
28
17
22
24
11
23
13
12
D

ANTENNA FOR A RADIO-CONTROLLED WRISTWATCH

BACKGROUND OF THE INVENTION

The invention concerns a radio-controlled wristwatch and in particular to an antenna therefor.

In a timepiece of the general kind set forth, as disclosed in German Document 93 18 224.4, a longwave antenna consisting of a coil and a cylindrical ferrite core for the reception of the encoded absolute time information is arranged beside a printed circuit board of an electronic module in the wristwatch casing. The antenna is parallel to a strap connection in a hollow space provided in a thickened horn base portion. Particularly in the case of small wristwatch casings such as for ladies' wristwatches, that necessitates a very short ferrite bar and a correspondingly low level of antenna sensitivity. It is for that reason that the reception of usable time telegrams is possible only under very good receiving conditions or with an extremely sensitive receiver. However, it is precisely when the receiver has a high level of sensitivity that such time telegrams can easily be adversely affected in terms of their decodability by external interference sources or by interference sources which are internal to the timepiece, such as in particular the high frequency clock generator for operating the processor.

A greater degree of immunity from interference as a result of a higher level of antenna sensitivity and a reduction in the required degree of receiver sensitivity is achieved by means of a larger core mass for the magnetic longwave antenna. Ganter et al. U.S. Pat. No. 5,430,693 (corresponding to EP 0 649 076-A3) provides a core which is no longer a cylindrical coil carrier but rather a ferrite plate which substantially fills the casing diameter. The plate serves at the same time as a carrier for mechanical and electrical components and for the circuitry of the electronic timepiece module. In that arrangement the antenna coil is arranged on a lateral projection of the ferrite plate. A shaped ferrite component of that kind however is expensive to produce and requires a high degree of dimensional precision for dimensionally accurately receiving the other mechanical and electrical components of the timepiece. Also, a plate, especially a plate with locally weakened portions for receiving the timepiece components and the antenna coil, is in great danger of fracturing in a situation involving a shock loading.

For installation of an antenna in a space of angled configuration in small timepiece casings, Ganter et al. U.S. Pat. No. 4,947,179 (corresponding to EP 0348 636 A1) provides that the antenna be formed of for example flexible strips which are displaceable relative to each other and which comprise soft-magnetic materials of high permeability such as in particular amorphous metals in sheet form. The strips are designed in an angled configuration substantially in the shape of an L, U, or Z, depending on the local circumstances of installation, in order to make optimum use of the spaces available in the timepiece casing for installing the antenna and in order to embody different reception orientations. A flexible core stack comprising individual, magnetically effective strips can thereafter also be curved or bent to form a portion of a ring in order to represent the longwave antenna, as part of a bangle. In contrast, in the case of a radio-controlled wristwatch, provision is made for displacing the antenna into its watch bracelet. Disadvantages involving the provision of angled spaces in the casing are the complicated shaping required and the resulting high level of assembly expenditure, as well as the comparatively short effective length (as measured by way of projection) of such a core geometry which extends in an angled configuration. While the installation of a flexible stack of strips in the wristwatch bracelet admittedly produces optimum reception conditions in regard to the distance from interference sources which are internal to the wristwatch and in regard to the effective core length, the flexible connection from the antenna coil to the receiving circuit by way of the bracelet connection to the wristwatch casing is in practice highly susceptible to wear.

In consideration of those facts an object of the present invention is to provide a magnetic longwave antenna for a radio-controlled wristwatch which represents an optimum compromise between the previously known extremes in regard to sensitivity to interference and antenna sensitivity and which is easy to handle in production and which is distinguished by a high level of mechanical stability.

SUMMARY OF THE INVENTION

In accordance with the invention the objects are attained by a radio-controlled wristwatch comprising a casing, a printed circuit board disposed in the casing, and an antenna disposed in the casing. The antenna includes a core and a coil carried by the core. The core comprises a stack of soft-iron strips stacked in a direction parallel to a plane of the circuit board. The core is curved within a plane oriented parallel to the plane of the circuit board and extends along and adjacent to an outer peripheral edge of the circuit board.

In accordance with that construction there is provided a highly flexible coil core which is stratified from long soft-iron laminations and extends in the form of a portion of a circular arc along the edge of the (main) printed circuit board, i.e. the circuit board of the electronic module of the radio-controlled movement. The core is fixedly connected to the printed circuit board, which imparts a high level of mechanical stability to the core. The fact that it extends at the edge of the printed circuit board and thus in close proximity to the electrically non-conducting and magnetically non-screening casing permits the largest possible spacing from the most critical internal interference source, namely the clock generator for processor operation, which as far as possible is disposed in diametrically opposite relationship to the antenna coil. The core should extend over an angle of arc of markedly more than 90°. Antenna efficiency is already very good with an angle of about 120°. The greatest effective length (projection or chord across the ends of the coil core) is achieved with a semicircular arc, that is to say an angle over 180°. Preferably however the curved core extends over an even greater angle, up to an order of magnitude of 240° and above. That admittedly does not afford any further rise in the effective core length but it nonetheless gives an increase in the level of antenna sensitivity because the ends of the coil core which extend beyond 180° act like field-collecting pole conductor portions. At the edge of the printed circuit plate outside the arc of the core there is a gap or space in which externally actuatable switching elements are provided. In addition it is desirable for the ends of the coil core to be spaced from each other by such a distance that, besides the switching elements, it is also possible to arrange a storage device (a primary battery or an accumulator for operation of the movement from a photovoltaic cell).

There is thus provided a radio-controlled wristwatch antenna which satisfies conflicting requirements such as a high level of efficiency in spite of small dimensions, which in that respect can be integrated into the overall function of the movement and which is shock-resistant (in accordance with DIN 8308) by virtue of the stacking of long narrow laminations of amorphous metal. This flexible pack which is stiffened by being frozen in the definitive spatial shape and which in that connection is glued flush onto the electronic module of the radio-controlled movement, is mechanically stabilized by the closely adjacent timepiece casing. In spite of involving a minimum space requirement, the arrangement, while making best use of the available-space, affords an antenna coil core of the largest possible effective length if it is adapted in a semicircular configuration to the movement diameter, whereby it is possible at the same time to achieve the greatest possible distance from interference sources which are internal to the movement.

BRIEF DESCRIPTION OF THE DRAWING

The objects and advantages of the invention will become apparent from the following detailed description of a preferred embodiment thereof in connection with the accompanying drawing in which like numerals designate like elements, and in which:

The sole FIGURE of the drawing shows the electronic module of a radio-controlled wristwatch viewing towards the printed circuit board which is surrounded by the wristwatch casing, without having regard to the gear assembly for the analog hands time display.

DETAILED DESCRIPTION OF A PREFERRED EMBODIMENT OF THE INVENTION

The annular casing 11 of a radio-controlled wristwatch 12 forms an internal space, which in this example is circular in cross-section. That space is substantially occupied by a main printed circuit board 13 which is of approximately circular configuration along its outer edge. The board provides for electrical connection and mechanical mounting of the components of the electronic module of the radio-controlled movement. The board is, for example, of a diameter of typically only 2.2 cm. This main printed circuit board 13 is to be arranged behind a transmission unit which is operable in itself, for the electronic radio-controlled timepiece functions, as is described in greater detail in regard to the association of gears with a light barrier assembly in our U.S. Pat. No. 5,898,644, the disclosure of which is incorporated herein by reference. The components mounted on the board include in particular a quartz-stabilized receiver-circuit 14 for demodulation of the time telegrams which are propagated by way of long wave, with the encoded absolute time, and a processor 15 for decoding the time telegrams, for comparison thereof with the time which is instantaneously displayed by the hands of the timepiece, and for correction of that time display in the event of deviations from the current time which is received by way of radio transmission, as is described for example Allgaier et al. U.S. Pat. No. 4,650,344 (corresponding to EP 0 180 155 B1), in the disclosure of which is incorporated herein by reference. The clock frequency of the processor 15 is stabilized by means of a further oscillation quartz 16. Various discrete capacitors 17 which are arranged in smaller and larger groups are provided for capacitive circuits. Holes 18 serve for the passage therethrough of the shafts for the gears of the gear and hands assembly, which are themselves not shown. For detecting the positions of the hands, in accordance with DE 35 10 861 C2, the disclosure of which is incorporated herein by reference, there is arranged on the main printed circuit board 13 at least one light barrier element 19 for sensing the angular positions of given gears of the transmission unit. A relatively large recess 20 at the edge 23 of the printed circuit board 13 of the electronic module serves to receive a button-like storage device 21 for operation of the electronic module, that is to say the receiver, processor and drive circuits. That storage device 21 may be a primary battery or a chemical or electrical storage device (accumulator or capacitor) for operation of the timepiece circuitry for example with a photovoltaic cell. Smaller recesses 22 are also formed in the edge 23 and those recesses 22 are overlaid by spring tongues 24. Those tongues can be actuated from outside the casing 11 for example by means of pushrods in order to trigger a switching function for example in the processor 15, by virtue of the spring tongue being bent until it bears against a counterpart contact 25 which is fixed on the printed circuit board 13 and situated in a recess 22. For that purpose, both spring tongues 24 are preferably at the same reference or ground potential in order to enable a common electrical and mechanical connection to the edge of the printed circuit board 13. In the interest of a low level of magnetic coupling, a stepping motor 30 for the time-keeping motion of the hands arrangement is, as far as possible, so oriented that its field coil is aligned substantially transversely with respect to a coil 27 of an antenna 26. Even if the receiver 14 is in mutually displaced relationship with respect to the stepping motor 30 in order to avoid reception disturbances, the magnetic decoupling of the two closely adjacent coils contributes to further reliability in terms of reception operation.

For reception of the time telegrams which are propagated by way of longwave transmission, the receiver circuit 14 is connected to the magnetic antenna 26. The antenna, in the manner of a frame antenna, includes the coil 27 which is tuned by one of the capacitors 17 to the carrier frequency of the time transmitter. To increase the level of sensitivity of the antenna 26, the coil 27 is carried by a laminated core 28 comprising a stack of flexible strips of soft-magnetic material of high permeability, such as in particular amorphous metals in sheet form. The coil 27, which projects beyond the cross-section of the core 28 engages into a free space 29 which has been cut out or removed at the edge 23 of the printed circuit board 13 so that the core 28 which extends out of the coil 27 bears against the printed circuit board 13 along the edge 23 thereof. In that arrangement the core 28 lies in a plane oriented parallel to a plane of the circuit board. The antenna strips are stacked in a direction D which is parallel to the plane of the circuit board. The strips extend in a curved configuration corresponding to the curvature of the peripheral edge 23 of the printed circuit board. Either this edge 23 (which is not necessarily arcuate in shape) or the contour of the adjacent casing 11 therefore determine the longitudinal sectional geometry of the core 28.

The arc should preferably extend for more than 90°. The greatest effective length of the core 28 that can be achieved in the interests of a high level of antenna sensitivity is afforded if the arc extends for an angle of at least 180 degrees. An angle greater than 180 degrees is illustrated, but it does not increase the effective antenna length over one having a 180 degree length, but it nonetheless increases the level of antenna sensitivity because those ends of the laminated soft-iron core, which project beyond 180°, but not greater than about 240°, have a field-strengthening effect like pole shoes and somewhat reduce the directional sensitivity of the antenna coil.

In the manufacturing process, the laminated soft-iron core 28 which passes through the antenna coil 27 is curved in accordance with the curved geometry of the inside wall of the casing 11 or the edge 23 of the printed circuit board, and the coil 27 is tuned to the fixed transmission frequency of the time transmitter (in particular DCF 77) by displacement on the core 28 or by a capacitive circuitry 17. For the purposes of fixing the coil position and the arc geometry, the core 28, together with the coil 27, is put into a casting tool and embedded within synthetic resin or other adhesive. The composite 27-28 which is hardened in that way is bonded onto the printed circuit board 13 adjacent the edge 23, with the antenna coil 27 projecting into the space 29. Alternatively, the printed circuit board 13 could be disposed on the casting tool in the correct positional relationship for joint hardening in the form of a further composite component 13-27-28. The arrangement combines an extremely small requirement for space, with an extremely stable fixing effect, at a distance which is highly desirable as it is very great from the most significant interference source (i.e., the processor 15 having the oscillation quartz 16). In addition, the core 28, which is curved and fixed in position, is protected in the optimum fashion from mechanical loadings by being supported practically over its entire length against the closely adjacent casing 11.

Under the limited spatial conditions within the wristwatch casing 11, the magnetic longwave antenna 26 of a radio-controlled wristwatch 12 therefore enjoys optimum conditions, in regard to antenna sensitivity and a shock-resistant construction, if the soft-iron core 28 which passes through the antenna coil 27 is in the form of a long stack of flexible plates or laminations which are fixed closely within the wristwatch casing 11 in an arc-like configuration adjacent the edge 23 of the printed circuit board, and if the core 28 extends over the largest possible peripheral angle but leaves a space between its ends for accommodating push-button switch spring tongues 24 and an electrical power storage device 21, and with the arrangement of the processor clock circuit having oscillation quartz 16 disposed in approximately diametrically opposite relationship with the antenna coil 27.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A radio-controlled wristwatch comprising a casing, a printed circuit board disposed in the casing, and an antenna disposed in the casing; the antenna including a core, and a coil carried by the core and having a larger cross section then the core; the core comprising a stack of soft-iron strips stacked in a direction parallel to a plane of the circuit board; the core being curved within a plane oriented parallel to the plane of the circuit board and extending along and adjacent to an outer peripheral edge of the circuit board; a recess formed in the circuit board and extending inwardly from the outer peripheral edge of the circuit board, the coil disposed in the recess; the stack of soft-iron strips being embedded within a bonding agent which fixes the shape of the core and bonds the core to the circuit board.

2. The radio-controlled wristwatch according to claim 1 wherein the curved core extends for an angle substantially greater than 90 degrees.

3. The radio-controlled wristwatch according to claim 2 wherein the angle is at least about 180 degrees.

4. The radio-controlled wristwatch according to claim 2 wherein the angle is greater than 180 degrees and not greater than about 240 degrees.

5. The radio-controlled wristwatch according to claim 2 wherein the outer peripheral edge of the circuit board includes recesses, push buttons disposed in respective ones of the recesses, and spring tongues mounted on the circuit board and arranged to be flexed for depressing respective ones of the pushbuttons.

6. The radio-controlled wristwatch according to claim 5 wherein the edge further includes an additional recess and an energy storage device mounted therein, one end of the core terminating adjacent to the additional recess.

7. The radio-controlled wristwatch according to claim 1 wherein the outer peripheral edge of the circuit board includes recesses, push buttons disposed in respective ones of the recesses, and spring tongues mounted on the circuit board and arranged to be flexed for depressing respective ones of the pushbuttons.

8. The radio-controlled wristwatch according to claim 7 wherein the edge further includes an additional recess and an energy storage device mounted therein, one end of the core terminating adjacent to the additional recess.

9. The radio-controlled wristwatch according to claim 1 wherein the core extends along a curved path generally corresponding to an internal contour of an adjacent wall of the casing.

10. The radio-controlled wristwatch according to claim 1 further including a processor including an oscillation quartz, the processor mounted on the circuit board in substantially diametrically opposite relationship to the coil.

11. The radio-controlled wristwatch according to claim 1 wherein the coil is embedded in the bonding agent.

* * * * *